US010612187B2

(12) United States Patent
Pagliai et al.

(10) Patent No.: US 10,612,187 B2
(45) Date of Patent: Apr. 7, 2020

(54) COATED STAPLE FIBER SUITABLE FOR OBTAINING HEAT-INSULATED AND FLOATING PADDINGS, AND PROCESS FOR OBTAINING SAID FIBER

(71) Applicant: GRADO ZERO INNOVATION S.R.L., Montelupo Fiorentino (FI) (IT)

(72) Inventors: Filippo Pagliai, Montelupo Fiorentino (IT); Giada Dammacco, Montelupo Fiorentino (IT); Enrico Cozzoni, Montelupo Fiorentino (IT)

( * ) Notice: Subject to any disclaimer, the term of this patent is extended or adjusted under 35 U.S.C. 154(b) by 145 days.

(21) Appl. No.: 15/580,188

(22) PCT Filed: Jun. 10, 2016

(86) PCT No.: PCT/IB2016/053424
§ 371 (c)(1),
(2) Date: Dec. 6, 2017

(87) PCT Pub. No.: WO2016/199079
PCT Pub. Date: Dec. 15, 2016

(65) Prior Publication Data

US 2018/0298550 A1 Oct. 18, 2018

(30) Foreign Application Priority Data

Jun. 12, 2015 (IT) ..... 102015000023333

(51) Int. Cl.
*D06M 13/517* (2006.01)
*D06M 10/08* (2006.01)
(Continued)

(52) U.S. Cl.
CPC ..... *D06M 13/517* (2013.01); *D06M 10/08* (2013.01); *D06M 11/79* (2013.01);
(Continued)

(58) Field of Classification Search
USPC ..... 428/359, 361, 364, 375, 378, 380; 427/180, 207.1, 402, 412, 419.3
See application file for complete search history.

(56) References Cited

U.S. PATENT DOCUMENTS

2018/0298550 A1* 10/2018 Pagliai ..... D06M 10/08

FOREIGN PATENT DOCUMENTS

GB 449979 A 7/1936
GB 590869 A 7/1947
(Continued)

OTHER PUBLICATIONS

Search Report of PCT/IB2016/053424 dated Sep. 23, 2016.
Written Opinion of PCT/IB2016/053424 dated Sep. 23, 2016.

*Primary Examiner* — Lynda Salvatore

(57) ABSTRACT

A coated staple fiber suitable for obtaining protective and floating padding, having a core consisting of at least one natural and/or man-made organic staple fiber and comprising: I) a base tackifier layer which covers the natural and/or man-made organic staple fiber and which comprises a hydrocarbon resin or similar tackifier, II) an intermediate heat insulating and fire retardant layer which covers the base layer and which comprises aerogel microparticles evenly but not continuously distributed, III) a top hydrophobic layer which covers the intermediate layer and which comprises organosilanes, wherein the base layer binds the intermediate layer to the natural and/or man-made organic staple fiber and the intermediate layer is included between the base layer and the top layer.

13 Claims, 5 Drawing Sheets

(51) Int. Cl.

| | |
|---|---|
| ***D06M 11/79*** | (2006.01) |
| ***D06M 15/227*** | (2006.01) |
| ***D06M 23/08*** | (2006.01) |
| ***D06M 13/02*** | (2006.01) |
| ***D06M 13/513*** | (2006.01) |
| ***D06M 101/06*** | (2006.01) |
| ***D06M 101/12*** | (2006.01) |
| ***D06M 101/32*** | (2006.01) |

(52) U.S. Cl.

CPC ..... *D06M 13/02* (2013.01); *D06M 13/513* (2013.01); *D06M 15/227* (2013.01); *D06M 23/08* (2013.01); *D06M 2101/06* (2013.01); *D06M 2101/12* (2013.01); *D06M 2101/32* (2013.01); *D06M 2200/12* (2013.01); *D06M 2200/30* (2013.01)

(56) References Cited

FOREIGN PATENT DOCUMENTS

| | | | |
|---|---|---|---|
| GB | 792624 | A | 4/1958 |
| GB | 794624 | A | 5/1958 |
| KR | 20130095134 | A | 8/2013 |

* cited by examiner

COATED STAPLE FIBER SUITABLE FOR OBTAINING HEAT-INSULATED AND FLOATING PADDINGS, AND PROCESS FOR OBTAINING SAID FIBER

This application is a U.S. national stage of PCT/IB2016/053424 filed on 10 Jun. 2016, which claims priority to and the benefit of Italian Application No. 102015000023333 filed on 12 Jun. 2015, the contents of which are incorporated herein by reference in their entireties.

FIELD OF THE INVENTION

The present description relates to a coated staple fiber having heat insulating, water repellency, buoyancy and fire retardant properties. In particular, such coated staple fiber is suitable for being used for filling floating and heat insulating padding.

In addition, the present description relates to a coating process of a natural and/or man-made organic staple fiber for making coated staple fiber having better heat insulating, water repellency, buoyancy and fire retardant properties than those of the natural fiber as such.

BACKGROUND INFORMATION

In the prior art it is known to use natural and/or man-made organic staple fibers. Natural staple fibers such as wool, cotton and kapok are well known. In particular, these fibers are used both for weaving garments and for making padding. In common usage, natural fibers are preferred over synthetic ones, both due to pollution and biodegradability concerns, since these fibers are totally organic, and for being hypoallergenic and biocompatible.

As mentioned above, natural fibers are used in the manufacture of padding due to their high heat insulating properties.

For example, the Kapok fiber is a totally organic plant fiber obtained from the seed pods of the plant by the same name, also known as *ceiba pentandra* and has a single cell structure (meaning that each fiber is composed of a single cell). The length of a Kapok fiber ranges between 10 and 30 mm, has a diameter between 20 and 40 microns, and is shaped like a thin hollow sheath. In other words, the kapok fiber has a substantially tubular shape.

The peculiarity of being hollow ensures excellent properties to the Kapok fiber, such as high heat insulation, good elasticity and buoyancy and good water repellency features. This combination of excellent properties is not found in any of the other natural staple fibers usually used (e.g., wool and cotton).

DRAWBACK OF THE PRIOR ART

In the prior art, natural staple fibers are used, such as wool, cotton and kapok, for making heat insulating padding. However, such fibers have drawbacks connected with their hygroscopic properties which affect the buoyancy thereof. In fact, padding made with natural fibers tends to absorb water, thus becoming quickly soaked.

Moreover, these fibers are highly flammable and can burn very quickly.

SUMMARY OF THE INVENTION

The object of the present invention is to provide a modified staple fiber having higher heat insulating, buoyancy and water repellency properties than those of natural staple fibers as such.

A further object of the present invention is to make a staple fiber with fire retardant properties.

A further object of the present invention is to implement a process that allows improving the heat insulating and hydrophobic properties of natural and/or man-made organic staple fibers to obtain modified staple fibers that exhibit technical buoyancy and heat protection properties that make them suitable for filling protective and floating padding.

These objects are achieved by a coated staple fiber according to claim 1 and by a process for making such a fiber according to claim 9.

OBJECTS OF THE INVENTION

The coated staple fiber object of the present invention allows achieving the following objects:

- Making heat insulating, hydrophobic and floating padding,
- Making fire retardant fabrics and padding,
- Combining the original properties of natural and/or man-made organic staple fiber with better heat insulating, hydrophobicity and buoyancy properties,
- Obtaining a hydrophobic coating.

These objects are achieved through the process of the invention with which the outer surface of a natural and/or man-made organic staple fiber can be modified to make a coated staple fiber.

BRIEF DESCRIPTION OF THE DRAWINGS

The features and the advantages of the present invention will appear more clearly from the following detailed description of a possible practical embodiment thereof, shown by way of a non-limiting example in the set of drawings, in which.

The coated staple fiber shown in the accompanying figures shall be considered to be represented schematically, not necessarily in scale and not necessarily with the proportions shown between the various component elements.

DETAILED DESCRIPTION

Although not explicitly mentioned, the single features described with reference to the specific embodiments shall be considered as ancillary and/or interchangeable with other features, which are described with reference to other exemplary embodiments.

The present invention relates to a coated staple fiber 1 suitable for making protective and floating padding and in particular, heat insulating, water-repellent and with fire retardant properties.

Figure 1:
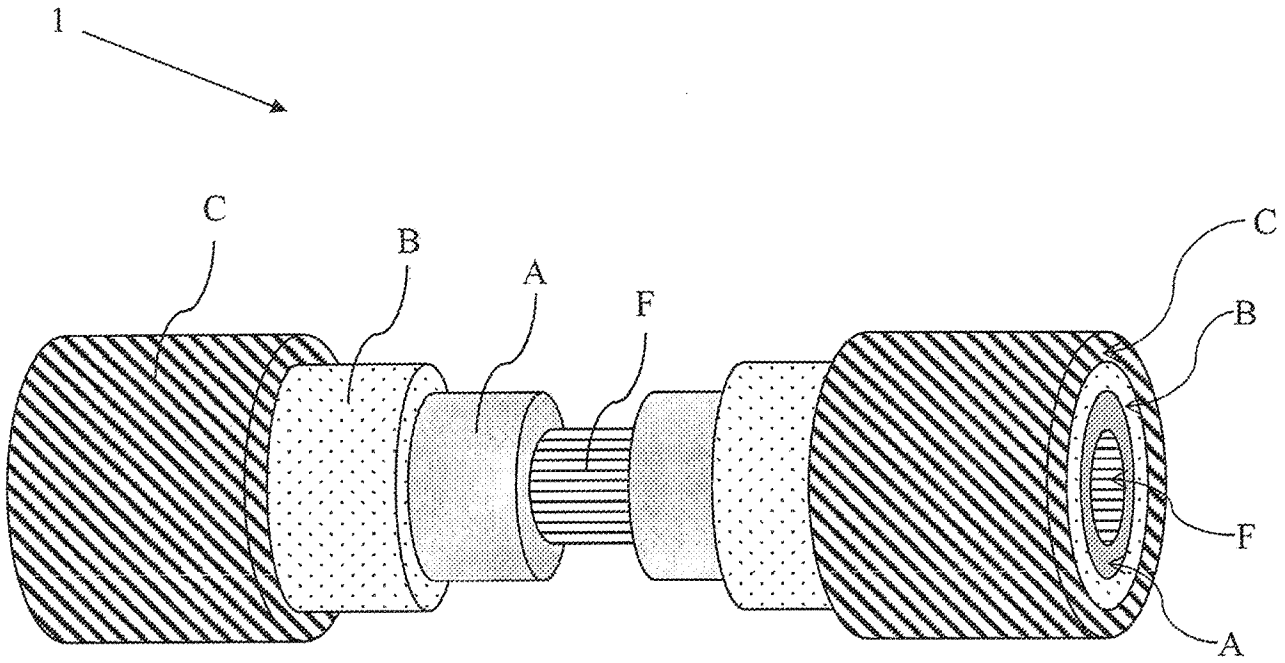
FIG. 1 shows a sectional view of a coated staple fiber according to the present invention.
Figure 2:
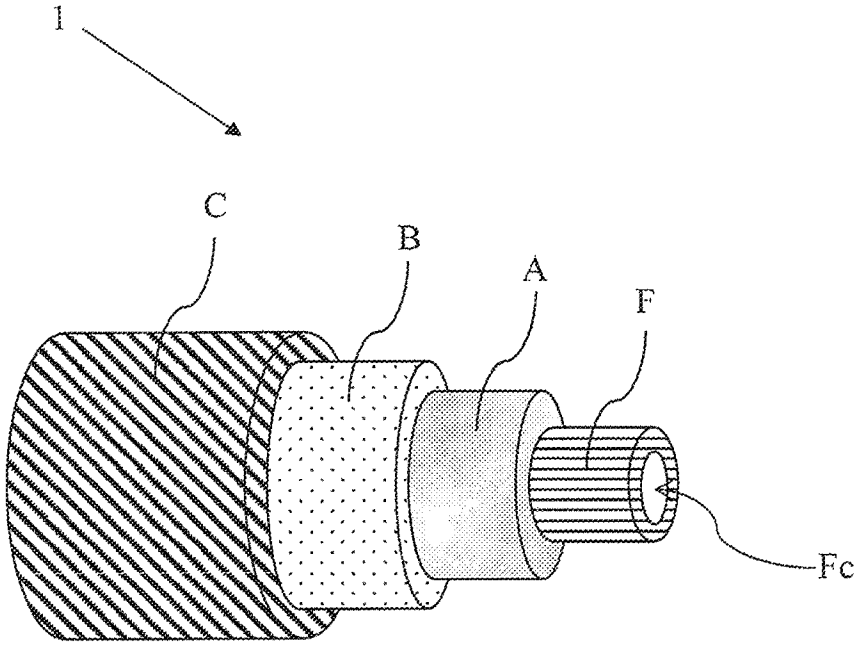
FIG. 2 shows a sectional view of a particular type of coated staple fiber according to the present invention.

With particular reference to FIGS. 1 and 2, the coated staple fiber 1 has a core comprising at least one natural and/or man-made organic staple fiber F. Preferably, the natural and/or man-made organic staple fiber F includes at least one natural staple fiber selected from: wool, cotton, kapok, or comparable cellulose fiber. Preferably, the natural and/or man-made organic staple F comprises at least a man-made (i.e., artificial) organic staple fiber; even more preferably, the at least one man-made organic staple fiber comprises a fiber of polylactic acid (i.e., PLA). Alternatively or in combination with the polylactic acid (PLA), the at least one man-made organic staple fiber comprises at least a man-made organic fiber of polyester (i.e., PES).

In other words, the natural and/or man-made organic staple F may comprise solely natural staple fibers selected from those listed above (eg., cotton, wool, kapok and cellulose), or alternatively man-made organic staple fibers preferably selected from those listed above (namely polylactic acid, PLA, or polyester, PES), or even a set of natural and man-made organic staple fibers.

According to a preferred solution, the natural and/or man-made organic staple fiber F comprises at least one natural staple fiber selected from wool, cotton, kapok and cellulose, and/or at least one man-made organic staple fiber comprising polylactic acid (PLA) and/or polyester (PES), the natural and/or man-made organic staple F having an outer surface Se.

Figure 3:
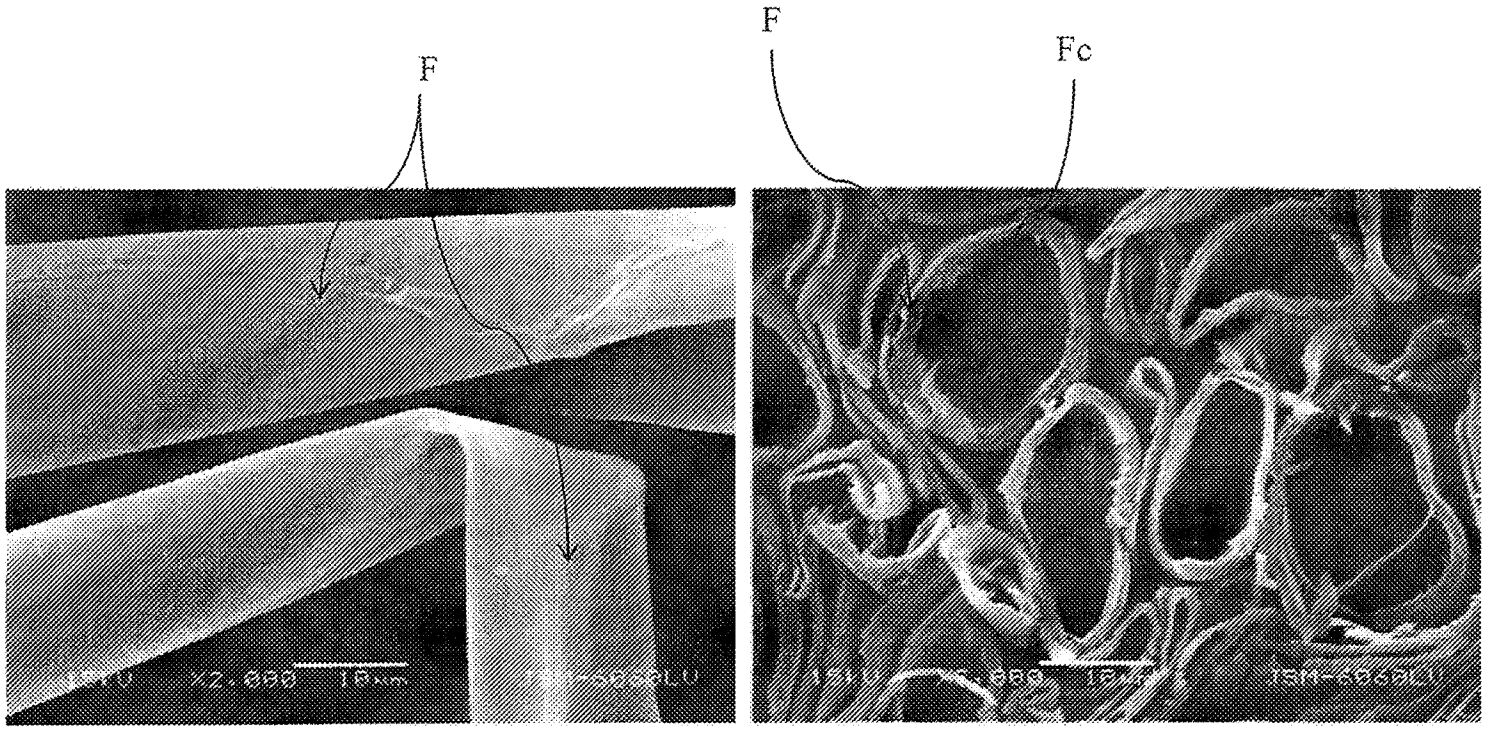
FIG. 3 shows an SEM image (2000× magnification) of a side a) and sectional b) view of a known kapok fiber not part of the invention.

According to another preferred solution of the present invention, the natural and/or man-made organic staple fiber F comprises at least one natural staple fiber selected from kapok and cellulose fiber, and/or at least one man-made organic staple fiber comprising polylactic acid (PLA) and/or polyester (PES), the natural and/or man-made organic staple fiber F having an outer surface Se and an inner surface Is. The inner surface Si defines an inner cavity Fc of the natural and/or man-made organic staple fiber F (FIGS. 3*a* and 3*b*). In other words, the kapok fiber of FIGS. 3*a* and 3*b* is hollow and has a substantially cylindrical outer surface Se and an also substantially cylindrical inner surface Is defining an inner cavity Fc. The same considerations can be repeated for natural hollow fibers made of cellulose or man-made organic based on polylactic acid (PLA), and/or polyester (PES).

The coated staple fiber 1 comprises a base tackifier layer A, which covers the natural and/or man-made organic staple fiber F. The base layer A comprises a hydrocarbon resin or similar tackifier.

Within the scope of the present invention, hydrocarbon resin is a tackifier resin wherein the presence in emulsion of amorphous hydrocarbon polymers with a low average weighted molecular weight $M_w$, preferably in the range of $570 \leq M_w \leq 860$, promotes adhesion, also in relation to the pressure and temperature parameters used. In order achieve the color and stability characteristics, hydrogenated resins may be used. Usually, these resins are colorless (clear white) and are very stable to heat, weather and oxidation. They are also hypoallergenic and do not cause skin sensitization. In order to ensure a more stable surface functionalization and improve adhesion, polymer modifiers and antioxidants as well as coupling and compatibilizing agents may be used/added. Additionally, different types of emulsifying resin and base polymer (e.g., in the family of polyolefins rather than monomers such as styrene, piperylene, indene) may be used to obtain a base layer A having tackifier properties compatible with the type of natural and/or man-made organic staple fiber F used. For example, in order to make a coated kapok fiber, shown in the scanning electron microscope (SEM) images in FIGS. 4*a* and 4*b*, compatibilized polypropylene was used as base polymer.

Preferably, polymer modifiers and antioxidants include hydrocarbon polymer modifiers such as piperylene and cyclopentadiene.

Preferably, the coupling and compatibilizing agents comprise silanes.

Preferably, the emulsifying resin comprises aliphatic resins, aromatic resins, mixtures thereof and hydrogenated aromatic resins.

In addition, the coated staple fiber 1 comprises an intermediate heat insulating and fire retardant layer B which covers the base layer A. The intermediate layer B comprises aerogel microparticles.

Within the scope of the present invention, aerogel is a gel in which the enclosed substance is air or other gas. Aerogels are among the lightest materials ever conceived as on average, they consist by 95% of air and only by 5% of the solid core. Their density is about 0.1 g/cm$^3$ but can reach a value of about 0.003 g/cm$^3$. Furthermore, aerogels are highly efficient heat insulators. The heat conductivity coefficient is less than 0.02 W/mK at atmospheric pressure and less than 0.01 W/mK at a pressure of 0.1 bar. Silica, carbon and alumina aerogels are known in the prior art. For example, silica aerogel is obtained from silica gel and is one of the known solid materials with the lowest density. In addition, silica aerogel is an excellent insulator for heat conduction, also due to the poor conductive properties of silica. Aerogels based on silica combined with carbon are known in the art with very high insulating properties. In addition, silica aerogel has a melting point of 1200° C., which gives it a high heat resistance.

Preferably, the intermediate layer B comprises microparticles of silica aerogel.

In addition, the coated staple fiber 1 comprises a top hydrophobic layer C which covers the intermediate layer B. The top layer C comprises organosilanes. In other words, the top layer C is a super-hydrophobic organosilicon film.

Within the scope of the present invention, organosilanes are chemical monomeric compounds of silicon, known as silanes. An organosilane (e.g., OMTS: octamethylcyclotetrasiloxane, an organic silicon compound with high hydrophobicity) is a silane containing at least one carbon-silicon (Si—C) bond in its structure. Organosilanes contain hydrophobic organic groups bonded to silicon, which impart the same hydrophobic character to the bonding surface (in this case, it is the intermediate layer B). For example, the phenyl silane and fluorinated silane groups add chemical resistance to the substrate, including detergents and disinfectants, through the creation of a hydrophobic surface comparable to the lotus leaf effect found in nature.

Preferably, the organosilanes comprise octamethylcyclotetrasiloxane (i.e., OMTS).

In particular, the base layer A binds the intermediate layer B to the natural and/or man-made organic staple fiber F. In other words, the base layer A is able to functionalize the surface of the natural and/or man-made organic staple fiber F so as to make the intermediate layer B (namely, the aerogel microparticles) adhere thereto due to its tackifier properties.

Advantageously, the base layer allows binding the natural and/or man-made organic staple fiber to the aerogel microparticles which form the intermediate layer b.

Moreover, the intermediate layer B is included between the base layer A and the top layer C. In other words, the intermediate layer B consists of aerogel microparticles included between the base layer A and the top layer C, so as to be sealed in the multilayer coating.

Figure 4:
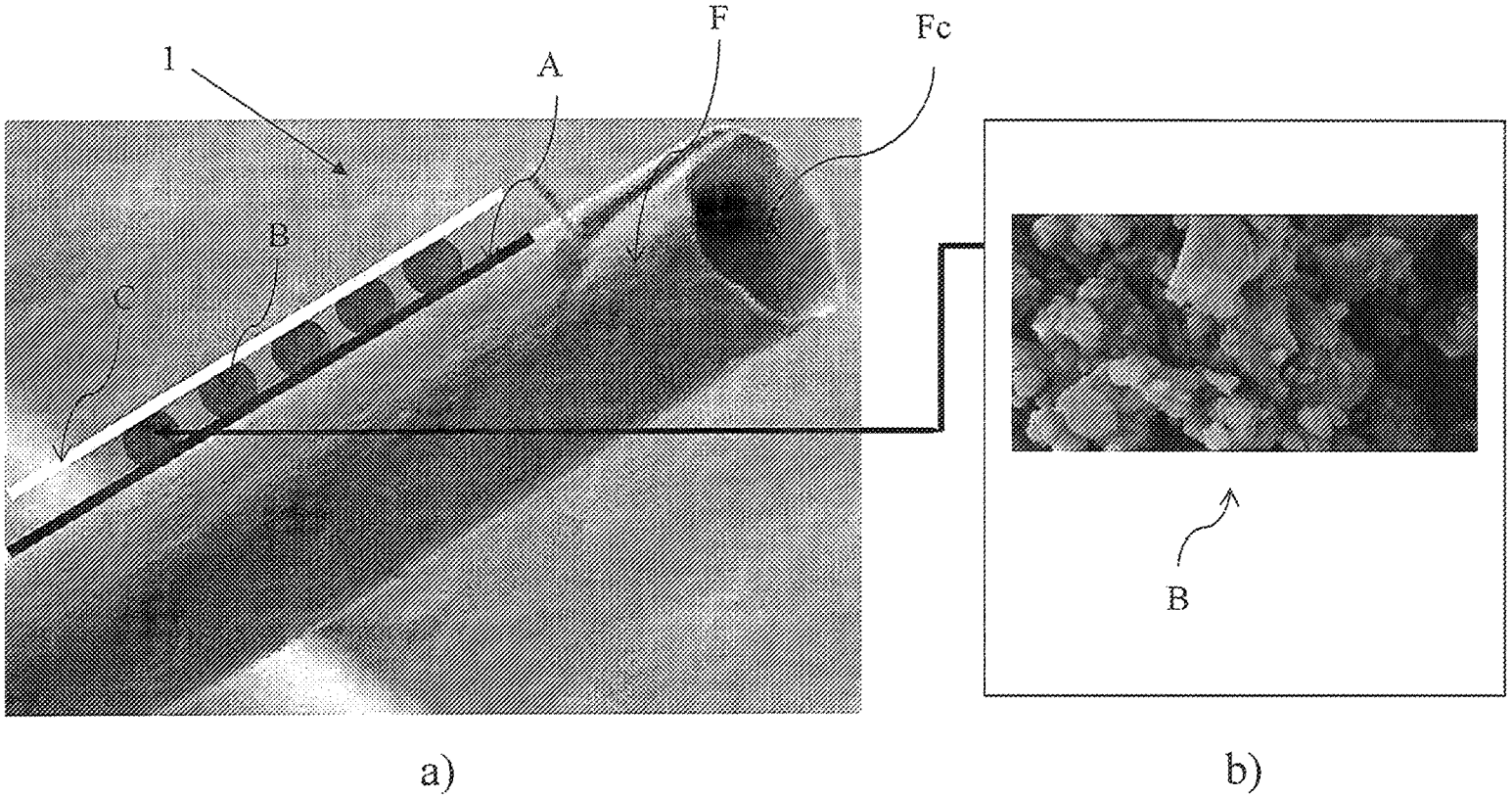
FIG. 4 shows: a) a SEM image of a coated kapok fiber according to the present invention, and b) a SEM image of a particular coating layer of the fiber in FIG. 4*a*)

According to a preferred embodiment, the base layer A only covers the outer surface Se of the natural and/or man-made organic staple fiber F (FIGS. 4*a* and 4*b*). Preferably, the intermediate layer B and the top layer C also concentrically cover the outer surface Se of the natural and/or man-made organic staple fiber F.

According to a preferred solution of the present invention, the base layer A, the intermediate layer B and the top layer C are arranged concentrically around the natural and/or man-made organic staple fiber F. This means that the base layer A directly adheres to the outer surface Se of the fiber, the intermediate layer B covers the base layer A and the top layer C covers layer B. In this way, the intermediate layer B is sealed in the central part of the coating due to the presence of the hydrophobic top layer C.

Advantageously, the inner surface Si of the kapok fiber is not occluded or filled by layers A, B and C. Therefore, the good flexibility, heat insulation and buoyancy typical of natural kapok fibers are preserved.

According to a preferred embodiment, the intermediate layer B consists of aerogel microparticles, which are deposited so as to adhere to the base layer A. In particular, the aerogel microparticles (e.g. based on micropowder silica gel) are heterogeneously distributed on the base layer A and are also incorporated between the base layer A and the top layer C. The intermediate layer B thus structured imparts high buoyancy and heat insulation to the coated staple fiber 1 since the intermediate layer B comprises aerogel microparticles which incorporate a considerable amount of air therein.

According to a preferred solution of the present invention, the base layer A is homogeneous film which evenly covers the outer surface Se of the natural and/or man-made organic staple fiber F.

Preferably, also the top layer C is a homogeneous film evenly covering the intermediate layer B so as to seal the aerogel microparticles due to the hydrophobic properties of organosilanes.

Advantageously, the hydrophobic top layer C seals the aerogel microparticles within the multilayer covering the natural and/or man-made organic staple fiber F. In this way, water and liquids cannot penetrate inside the multilayer and the aerogel particles. Therefore, the aerogel particles provide heat insulating and buoyancy properties to the entire coated staple fiber 1 due to the high porosity of the aerogel and to the consequent ability to retain air therein.

Advantageously, the aerogel microparticles B of the intermediate layer B also give resistance to high temperatures and fire retardant properties to the coated staple fiber 1.

Advantageously, the coated staple fibers 1 can be used for filling protective and floating padding, due to their heat insulating, fire retardant, buoyancy and water repellency properties.

Advantageously, the coated staple fibers 1 having a core consisting of kapok fibers have much higher heat insulating and buoyancy properties than those of cotton and wool fibers coated in a similar manner. This is due to the combination of the intrinsic properties of kapok fibers (which have an inner cavity filled with air) with the properties of the coating formed by layers A, B and C. Similar advantages are found for the hollow fibers made of cellulose, polylactic acid (PLA), and polyester (PES).

The present disclosure also relates to a process for making coated staple fibers 1 having the features described above.

The process for making coated staple fibers with hydrophobic, buoyancy, heat insulating and fire retardant properties comprises the following steps.

The first step a) which consists in providing at least one natural and/or man-made organic staple fiber F, preferably the natural staple fiber is selected from wool, cotton, cellulose and kapok, while the man-made organic staple fiber comprises polylactic acid (PLA) and/or polyester (PES). Even more preferably, the natural staple fiber comprises a kapok fiber.

This step a) is followed by a subsequent step b): coating the natural and/or man-made organic staple fiber F with a hydrocarbon resin to functionalize the outer surface Se of the natural and/or man-made organic staple fiber F so as to make the base tackifier layer A.

Preferably, step b) comprises a step of vaporization deposition of the hydrocarbon resin on the outer surface Se of the natural and/or man-made organic staple fiber F, so as to obtain a homogeneous and even base layer A. Such vaporization step can be carried out by spraying the hydrocarbon resin without the need of using precursors.

Preferably, during the emulsion polymerization, an emulsifying, a stabilizing agent, a surface tension adjuster, a catalyst/oxidizing agent and a buffer substance are used to accelerate the adhesion. Such secondary agents are added to the main monomeric component.

Preferably, the emulsifying agent includes alcohol-amine sulfonic acid soaps and quaternary ammonium salts or other surfactant ionic compounds.

Preferably, the stabilizing agent includes casein.

Preferably, the surface tension regulator includes mixtures of aromatic alcohols, aliphatic alcohol-amines and alcohols with at least 8 carbons.

Preferably, the catalyst/oxidizing agent includes oxygen, ozone, peroxides, persulfates and chlorinated aliphatic compounds.

Preferably, the buffer substance includes phosphates, carbonates and acetates.

Preferably, the main monomeric component includes styrene, piperylene and indene.

Alternatively, the base layer A may be deposited on the natural and/or man-made organic staple fiber F by immersion of the fiber in the (liquid) emulsion described above. In the particular case of kapok fibers, such a deposition process of the hydrocarbon resin must last for a short time to prevent the inner cavity Fc from filling.

The tests carried out so far by the Applicant have been based on the use of aromatic hydrocarbon resins C9 commonly available on the market, subsequently hydrogenated to increase the stability thereof and fix the optical and olfactory features thereof. The aromatic resins C9 used were produced from a solution/compound C9 (resin) containing various monomers (mainly styrene, piperylene, indene in percentages—by weight—ranging between 10% and 30%), subjected to cationic polymerization reaction to convert the liquid into a tackifier resin having higher viscosity (up to 5.5 Pa·s at 25° C.). Resins C9 contain several double bonds that are relatively unstable. An effective manner to stabilize these resins is to hydrogenate them. Resins C9 are aromatic ring structures with a total aromaticity of around 40% (measurement made by "Protonic Nuclear Magnetic Resonance"). Hydrogenation of resins is carried out in solution with precise operating parameters: temperature, pressure, concentration of hydrogen and catalysis level. Changing any of these operating parameters leads to a change in the degree of hydrogenation of the final resin. During hydrogenation, the aromatic ring structures gradually lose their nature and become cycloaliphatic. In the specific process, different degrees of hydrogenation were tested, allowing the process to complete from 50% to 100%. Where the process was not fully completed, partially hydrogenated resins still have some aromatic rings.

Step b) is followed by step c) which consists in coating the base layer A of the modified natural and/or man-made organic staple fiber F obtained through step b), with aerogel microparticles so as to achieve the heat insulating intermediate layer B. Preferably, step c) comprises a step of vaporization deposition of the aerogel microparticles on the base layer A, so as to obtain a heterogeneous intermediate layer B.

The preparation of aerogels is done by removing the liquid phase contained in a gel: what remains is a solid matrix having the same size and shape as the starting gel in which the liquid is replaced by air. The removal of the liquid, however, cannot be performed by simple drying, otherwise the solid matrix would collapse, resulting in rupture or decrease of porosity. Instead, it can be performed by bringing the liquid to supercritical conditions and slowly decreasing the external pressure. In such conditions, the fluid leaves the gel without a separation of liquid-vapor phase, which is probably the source of the negative effects of simple drying.

Preferably, the aerogel microparticles comprise microparticles of silica aerogel.

It should be pointed out that the base tackifier layer A functionalizes the outer surface Se of the natural and/or man-made organic staple fiber F making it receptive to the subsequent dispersion of the aerogel microparticles of layer B. The most important aspect to be considered in the dispersion/vaporization of the aerogel is the fact that the solid particles must be made to adhere in a discontinuous manner only on the outer surface Se of the natural and/or man-made organic staple fiber Fc, preventing the penetration of micropowders into the inner cavity Fc of the kapok, cellulose, polylactic acid (PLA and/or polyester (PES) fiber. In fact, the inner cavity Fc peculiar of the Kapok fiber (FIGS. 3*a*, 3*b*, 4*a*, 4*b*) must not be filled with an agent that may affect the heat regulation and buoyancy properties typical of such a fiber. Of course, since the Kapok fiber contains a greater amount of waxy substance compared to wool and cotton fibers, the penetration of the hydrocarbon resin of the base layer A and of aerogel micropowders in the interstices between the fiber is almost zero. This is of course promotes the formation of a homogeneous hydrocarbon resin film, to which the aerogel microparticles are discontinuously adhered. In this regard, reference shall be made to FIGS. 4*a* and 4*b* which show the SEM images of a coated kapok fiber made by vaporization (FIG. 4*a*) and an enlargement of the surface coated with aerogel microparticles (FIG. 4*b*), respectively. Due to their large surface area, low density, open pore structure and excellent insulating properties, aerogels and silica in particular have long been used in different industrial applications, although not in the textile field, to which this invention is mainly directed. Due to their mechanical properties, the manufacturing process of microparticles, especially spherical ones, milling or crushing of monolithic aerogel is somewhat difficult. However, there are methods of production of spherical microparticles of aerogel using emulsion techniques ("in-situ" production) followed by supercritical extraction of the dispersion (gel-solvent).

For example, the emulsion is produced by mixing the sol (the dispersed phase) with a solvent, also of plant origin (continuous phase) followed by the gelification of the dispersed phase: sol-gel (silica gel). Preferably, the sol solution is produced using a liquid alcohol (e.g. ethanol) and a Si(OR)4 (silicon alkoxide) precursor. The supercritical drying process allows the alcohol to be removed from the gel. This process is carried out preferably using acetone as a solvent, which solubilizes the ethanol, and using the supercritical CO2 to remove all the liquid phase from the gel, which is replaced by gas, without allowing the whole structure to collapse due to a decrease in its volume. The final particle size distribution of the aerogel particles was influenced by the stirring process, by the concentration of surfactant and sol: solvent volume ratios. The gel-solvent dispersion was, as described, extracted with the aid of supercritical CO2. Advantageously, the choice of the supercritical solvent allows reducing the costs of material, having a reduced environmental impact because it is non-toxic, does not damage the ozone layer, does not pollute and does not contaminate the extracts, and both its critical temperature and critical pressure, equal to 31.1° C. and 73.8 bar, respectively, can be easily reached. The silica aerogel microparticles thus obtained have a spherical shape with a surface area of 1100 $m^2$ g−1, pore volume of 3.5 $cm^3$/g and different average particle diameters ranging from 50 to more than 200 microns. The application process of these microparticles can be obtained in a vacuum bag by simple direct dispersion on fibers previously treated with the tackifier resin and "dried" for 5 seconds with UV curing (150 W). The use of a hydrogenated hydrocarbon resin C9 (70%) for the direct vaporization, also in vacuum bag (2 applications; 1 hour time between the applications; 500 ml per 5 kg of kapok fiber previously treated with plasma activation process: RF 13.56 MHz, pressure in the range of few mTorr—760 Torr: atmospheric pressure) ensured that the hollow sheaths of the fiber remained such and were not filled.

d)—coating the intermediate layer B of the modified natural and/or man-made organic staple fiber F, obtained by step c), with organosilanes so as to obtain the hydrophobic top layer C. Step d) comprises a step of vaporization deposition of the organosilanes on the intermediate layer B, so as to obtain a homogeneous and even top layer C. In other words, aerogel micropowders are microencapsulated between the base layer A and the top layer C (FIGS. 4*a* and 4*b*). Monomeric silicon chemicals are known as silanes. A silane containing at least one silicon-carbon bond (Si—C) is known as an organosilane. In the chemistry of organosilanes, an emerging application is the development of "smart" surface treatments. This translates into making these surfaces hydrophobic/oleophobic and/or hydrophilic (e.g. through the use of fluoro silanes and of the sol-gel technology described above), as well as giving surface super-hydrophobicity effects induced by microroughness (lotus leaf effect).

According to a preferred embodiment of the invention, the step b) of deposition of the adhesive hydrocarbon resin on the base layer A and the step c) of discontinuous adhesion of the aerogel microparticles are carried out using UV (e.g., UV-curing), plasma, or ultrasonic treatments. In fact, such treatments promote the adhesion of the layers on the natural staple fibers F.

By way of example, the Applicant has conducted experimental trials (accompanying FIG.) where octamethylcyclotetrasiloxane (OMCTS) was deposited by means of a plasma process (i.e., "Atmospheric Glow Discharge") for obtaining a hydrophobic surface film on a cotton fabric. The modified surface showed super-hydrophobicity (i.e., easy to clean and water repellency) properties.

According to a preferred embodiment, step b) is preceded by a step of purification and/or bleaching (i.e., bleaching) of the natural and/or man-made organic staple fiber F. In other words, the natural and/or man-made organic staple fiber F is purified and/or bleached before the deposition of the base layer A. This purification and/or bleaching step can be carried out using a conventional method which uses a purification agent and/or an oxidizing agent, respectively. It should be noted that the use of an excessive purification and bleaching step could affect the adhesion of the hydrocarbon resin to the base layer A. Therefore, it is preferable to only carry out the bleaching of the natural staple fiber F to remove the yellow or brown pigment adhering to the fiber.

Using the above process it is possible to obtain a coated staple fiber 1 having a surface that takes the shape of an irregular wave, with a super-hydrophobic outer layer (i.e., top layer C). The aerogel micropowders between two layers A and C allow the fiber to have fire retardant and flame extinction properties. In addition, the aerogel allows improving the heat regulation properties of the fiber, increasing the buoyancy thereof due to the super-hydrophobicity of the coating.

Below is an example of manufacture of coated staple fibers 1 by the process of the present invention.

EXAMPLE 1

The selected staple fiber (kapok) was not subjected to bleaching operations but was instead subjected to plasma surface activation treatment (RF 13.56 MHz, pressure in the range of few mTorr—760 Torr: atmospheric pressure) to increase the resiliency thereof and (pre-)functionalize the surface (i.e., increase the wettability) thereof Application of hydrogenated hydrocarbon resin C9 (70%) by direct vaporization in vacuum bag: 2 applications; 1 hour time between the applications; 500 ml per kg of fiber.

UV curing on the fiber (150 W; 15/20 cm; 5 s).

Application of silica aerogel micropowders (particles on an average of 100/150μ) in vacuum bag by direct dispersion: 30 ml per 500 g of fiber.

Application of organosilane top coat, also by vaporization. Treatment in nano-dispersion of reactive amino-functional silanes/siloxanes combined with fluoro silanes in an emulsion containing polyethylene, paraffin and water. The surface treatment based on organomodified silanes and siloxanes combined with fluoro silanes is characterized by the low emission of VOC volatile substances and by a high flash point (>70° C.) and low toxicity. The addition of the fluoro silanes significantly increases the duration of hydrophobicity. The dispersion is further characterized by a low molecular weight which allows excellent penetration and adhesion with the treatment (base coat) described above: 2 applications; 1 hour time between the applications; 500 ml per kg of fiber.

UV curing on the fiber (150 W; 15/20 cm; 5 s).

EXAMPLE 2

Figure 5:
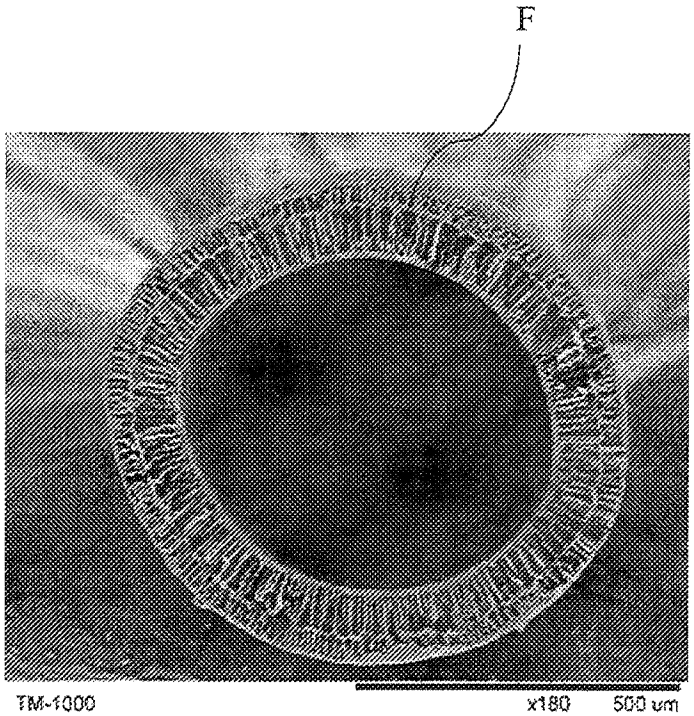
FIG. 5 shows a SEM image of a polylactic acid hollow fiber (180× magnification).

In this embodiment, the natural and/or man-made organic staple fiber F was made of kapok fiber mixed with polylactic acid fiber (PLA) with internally hollow tubular fibers, or alternatively in polylactic acid fiber (PLA) internally hollow and tubular, as shown in the image of FIG. 5 realized with a scanning electron microscope.

The structural formula of the polylactic acid (PLA) is given below:

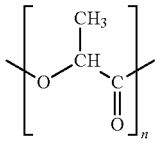

The method steps are listed below with reference to the present embodiment.

Step of coating with liquid solution, sol-gel obtained through the treatment of an organic-inorganic mixture to the state of sol with polysiloxane:

Reactive organic-inorganic compound, selfcrosslinking silicon-based.

pH (10% solution): 4-5.

Slightly cationic.

Stable solutions with hard water and weak acids.

Partially stable in alkaline environments.

Specific gravity (at 20° C.): 1 kg/litre.

AEROGEL: silicon powders.

Particles: 100-700 μm (0.1-0.7 mm).

Porosity: ~20 nm.

Density: 120-150 kg/m3.

Surface character: hydrophobic.

Surface area: 600-800 $m^2/g$.

Tests

Liquid Solution:

1/10 comprising silicone/water.

1/5 silicone/water mixture.

Quantity of Dispersed Particles:

5/15/30/50 ml per 250 ml of liquid solution.

Of course, a man skilled in the art may make several changes to the variants described above in order to meet specific and incidental needs, all falling within the scope of protection as defined by the following claims.

The invention claimed is:

1. Coated staple fiber suitable for obtaining protective and floating padding, having a core comprising at least one natural and/or man-made organic staple fiber, said coated staple fiber comprising:

a base tackifier layer which covers said natural and/or man-made organic staple fiber and comprises a hydrocarbon resin, an intermediate heat insulating and fire retardant layer which covers said base layer and comprises aerogel microparticles, a top hydrophobic layer which covers said intermediate layer and comprises organosilanes, wherein:

said base layer binds said intermediate layer to said one natural and/or man-made organic staple fiber, said intermediate layer is included between said base layer and said top layer.

2. Coated staple fiber according to claim 1, wherein said natural and/or man-made organic staple fiber comprises at least one natural staple fiber selected from wool, cotton, kapok and cellulose, and/or at least one man-made organic staple fiber comprising polylactic acid and/or polyester, said natural and/or man-made organic staple fiber has an outer surface.

3. Coated staple fiber according to claim 1, wherein said natural and/or man-made organic staple fiber comprises at least one natural staple fiber selected form kapok and/or equivalent cellulose fiber, and/or at least one man-made organic staple fiber comprising polylactic acid and/or polyester, said natural and/or man-made organic staple fiber has an outer surface, and an inner surface which defines an inner cavity of said natural and/or man-made organic staple fiber.

4. Coated staple fiber according to claim 2, wherein said base layer covers said outer surface of said natural and/or man-made organic staple fiber.

5. Coated staple fiber according to claim 3, wherein said base layer covers said outer surface of said natural and/or man-made organic staple fiber.

6. Coated staple fiber according to claim 1, wherein said base layer and said intermediate layer and said top layer are arranged in a concentric manner around said natural and/or man-made organic staple fiber.

7. Coated staple fiber according to claim 1, wherein said intermediate layer comprises microparticles of silica aerogel.

8. Coated staple fiber according to claim 1, wherein said intermediate layer consists of aerogel microparticles deposited so as to adhere to said base layer and heterogeneously distributed on said base layer.

9. Coated staple fiber according to claim 2, wherein said base layer is a homogeneous layer and uniformly covers said outer surface of said natural and/or man-made organic staple fiber, said top layer is homogeneous and uniformly covers said intermediate layer.

10. Coated staple fiber according to claim 1, suitable for obtaining protective and floating padding, having a core comprising at least one natural staple fiber, said coated staple fiber comprising:

a base tackifier layer which covers said natural staple fiber and comprises a hydrocarbon resin, an intermediate heat insulating and fire retardant layer which covers said base layer and comprises aerogel microparticles, a top hydrophobic layer which covers said intermediate layer and comprises organosilanes, wherein:

said base layer binds said intermediate layer to said one natural staple fiber, said intermediate layer is included between said base layer and said top layer.

11. Process for obtaining coated staple fibers according to claim 1, comprising the steps of:

a)—providing at least one natural and/or man-made organic staple fiber, b)—coating said natural and/or man-made organic staple fiber with a hydrocarbon resin, so as to obtain said base tackifier layer, c)—coating said base layer of said natural and/or man-made organic staple fiber modified by said step b) with aerogel microparticles, so as to obtain said intermediate heat insulating layer, d)—coating said intermediate layer of said natural and/or man-made organic staple fiber modified by said step c) with organosilanes, so as to obtain said hydrophobic top layer.

12. Process for obtaining coated staple fibers according to claim 11, wherein said step b) comprises a step of vaporization deposition of said hydrocarbon resin on said natural and/or man-made organic staple fiber, so as to obtain said base layer, said step c) comprises a step of vaporization deposition of said aerogel microparticles on said base layer, so as to obtain said intermediate layer, said step d) comprises a step of vaporization deposition of said organosilanes on said intermediate layer, so as to obtain said top layer.

13. Process according to claim 12 wherein said steps b) and/or c) comprise the use of UV radiations, ultrasound or plasma.

* * * * *